US007322074B2

(12) United States Patent
Takeuchi et al.

(10) Patent No.: US 7,322,074 B2
(45) Date of Patent: Jan. 29, 2008

(54) CYLINDER BAND FOR BUOYANCY REGULATOR

(76) Inventors: Minoru Takeuchi, c/o Tabata Co., Ltd., 1-3-17 Higashi-Komagata, Sumida-ku, Tokyo (JP); Yuji Kuroda, c/o Tabata Co., Ltd., 1-3-17 Higashi-Komagata, Sumida-ku, Tokyo (JP)

( * ) Notice: Subject to any disclaimer, the term of this patent is extended or adjusted under 35 U.S.C. 154(b) by 80 days.

(21) Appl. No.: 11/197,513

(22) Filed: Aug. 5, 2005

(65) Prior Publication Data

US 2006/0032028 A1 Feb. 16, 2006

(30) Foreign Application Priority Data

Aug. 12, 2004 (JP) ..... 2004-235337

(51) Int. Cl.
*A44B 11/12* (2006.01)

(52) U.S. Cl. ..... 24/71 ST; 24/71 R

(58) Field of Classification Search ..... 24/68 E, 24/68 R, 68 SK, 68 T, 69 SK, 69 ST, 71 CT, 24/71 R, 71 SK, 71 ST, 71 T, 69 R; 405/186; 441/111, 116

See application file for complete search history.

(56) References Cited

U.S. PATENT DOCUMENTS 1,084,057 A * 1/1914 Avelsgard ..... 24/71 ST
3,574,246 A * 4/1971 Norton et al. ..... 24/68 CD
4,918,790 A * 4/1990 Cirket et al. ..... 24/71 R
5,301,911 A * 4/1994 Beauchemin ..... 248/218.4
5,346,419 A * 9/1994 Kaiser ..... 441/96
6,579,138 B2 * 6/2003 Kawashima et al. ..... 441/116

FOREIGN PATENT DOCUMENTS

JP 2002-240784 8/2002

* cited by examiner

*Primary Examiner*—James R. Brittain
*Assistant Examiner*—Ruth C. Rodriguez

(57) ABSTRACT

A cylinder band for immobilizing an air cylinder on a buoyancy regulator includes a belt, a buckle and a coupler adapted to couple the belt and buckle. The buckle has a pair of parallel supporting walls, which have longitudinally opposite first ends and second ends. A pivot extends through the first ends, with end surfaces thereof defining cam surfaces that enhance a tensity of the belt as the second ends swing around the pivot while the end surfaces are in contact with the peripheral surface. The end surfaces each has a pair of convexly curved surface segments spaced from each other in the circumferential direction of the peripheral surface, which are adapted to contact the peripheral surface at once. A concavely curved surface segment extends between the convexly curved surface segments and has a curvature radius which is the same as or less than a radius of the peripheral surface.

2 Claims, 8 Drawing Sheets

CYLINDER BAND FOR BUOYANCY REGULATOR

BACKGROUND OF THE INVENTION

This invention relates to a cylinder band used to immobilize an air cylinder on a backplate of a buoyancy regulator for diving.

Cylinder bands used to immobilize an air cylinder on a backplate of a buoyancy regulator is well known. An example of such a cylinder band is disclosed in Japanese Unexamined Patent Application Publication No. 2002-240784 (REFERENCE). FIG. 7 of the accompanying drawings is a rear view showing the buoyancy regulator 101 disclosed in REFERENCE. For this buoyancy regulator 101, a cylinder band 102 is used. FIG. 8 is a sectional view of a belt 131 and a buckle 132 to illustrate procedures for use of the cylinder band 102. Referring to FIG. 7, the buoyancy regulator 101 comprises a jacket 103 adapted to be fed with air for buoyancy regulation, the cylinder band 102 and the backplate (not shown). An air cylinder 105 indicated by an imaginary line is immobilized on the backplate using the cylinder band 102. The air cylinder 105 is provided on its top with a first stage 108 from which a regulation hose 109 extends to a second stage (not shown). An inflation hose 112 extends to the dorsal side of the jacket 103. The cylinder band 102 comprises a belt 131 and a buckle 132 wherein the belt 131 extends through the dorsal side of the jacket 103 from the outer side to the inner side and again to the outer side and the buckle 132 allows the belt 131 to be length-adjusted.

In the case of the cylinder band 102 shown in FIG. 8, the belt 131 and the buckle 132 are coupled to each other with interposition of a coupler 135. A free end 134 of the belt 131 wound around the air cylinder 105 is guided successively in directions indicated by arrows P, Q, R and successively through a second insertion slit B and a third insertion slit C of the buckle 132 so that the air cylinder 105 may be somewhat tightened. From this state, the free end held with, for example, the left hand is lightly tugged to the left to strain the belt 131, on one hand, and a second end 172 guided through the slits of the buckle 132 held with the right hand is swung around a pivot 140 formed through the buckle 132 in a direction indicated by an arrow X, on the other hand. Consequentially, a region on an end surface 151 of a first end 171 in which the end surface 151 comes in contact with a peripheral surface 105*a* of the air cylinder 105 transfers from a region $M_1$ to a region $M_2$ and then to a region $M_3$ whereupon the buckle 132 rises on the peripheral surface 105*a* as indicated by imaginary lines. Distances $L_1$, $L_2$, $L_3$ from a center of A pivot 140 is fitted into a through-hole 152 formed through the first end 171. Distances from a center of the through-hole 152 to the respective regions $M_1$, $M_2$, $M_3$ are represented by $L_1$, $L_2$, $L_3$, respectively. The distance $L_2$ as well as the distance $L_3$ is larger than the distance $L_1$. Such end surface 151 defines a cam surface serving to enhance a tensity of the belt 131 having been guided through the insertion slits B, C as the second end 172 swings. However, the buckle 132 rising on the peripheral surface 105*a* as indicated by the imaginary lines is in unstable state since the region $M_3$ including the vicinity thereof in which the buckle 132 is in contact with the peripheral surface 105 presents a surface segment which is convexly curved toward the peripheral surface 105*a* or a flat surface segment. To keep the buckle 132 rising, the buckle 132 must be firmly supported with the right hand. With the buckle 132 supported in this manner, the free end 134 of the belt 131 is guided in a direction indicated by an arrow S through the insertion slit A with the left hand. Then the buckle 132 is further swung in a direction indicated by an arrow X while the free end 134 having been guided through the insertion slit A is maintained under an appropriate tensity until the buckle 132 is collapsed onto the peripheral surface 105*a* as indicated by imaginary lines in FIG. 8. In this way, the operation of immobilizing the air cylinder 105 by the cylinder band 102 is completed.

In the course of immobilizing the air cylinder 105 using the cylinder band 102 disclosed in REFERENCE, the belt 131 under a high tensity might move the buckle 132 in the direction opposite to the arrow X, i.e., move back to its position indicated by solid lines and the belt 131 might be slackened in the course of guiding the free end 134 of the belt 131 through the insertion slit A so far as the diver continues to support the buckle 132 with the left hand in order to keep the buckle 132 rising. In this manner, the diver is required to use his or her both hands continuously until the operation of immobilizing the air cylinder is substantially completed.

SUMMARY OF THE INVENTION

In view of the problem as has been described above, it is an object of this invention to improve the conventional cylinder band as disclosed in REFERENCE so that possibly occurring situations in which the diver is required to use his or her both hands to immobilize the air cylinder can be reduced as effectively as possible.

According to this invention, there is provided a cylinder band for a buoyancy regulator, comprising a belt adapted to be wound around a peripheral surface of an air cylinder destined to be immobilized on a backplate of the buoyancy regulator and having longitudinally opposite ends, and a buckle attached to one of longitudinally opposite ends by means of a coupler provided separately of the belt and provided with insertion slits through which the other of the longitudinally opposite ends may be guided to adjust a length of the belt.

The cylinder band according to this invention further comprises: the buckle comprising a pair of supporting walls extending in parallel to each other in a circumferential direction of the peripheral surface of the air cylinder destined to be immobilized on the backplate and a plurality of dividing walls extending between a pair of the supporting walls in parallel one to another in a longitudinal direction of the air cylinder, i.e., in a direction orthogonal to the circumferential direction of the air cylinder, each of the insertion slits being defined between each pair of the adjacent dividing walls. A pair of the supporting walls respectively have first ends and second ends opposed to the first ends in the circumferential direction of the air cylinder wherein the first ends are attached to the coupler so that the first ends swing around a pivot extending in the longitudinal direction of the air cylinder and the second ends swing off from or toward to peripheral surface of the air cylinder as the first ends swing around the pivot.

Each of respective end surfaces of the first ends defines a cam surface serving to enhance a tensity of the belt guided through the insertion slits and pressed against the peripheral surface of the air cylinder in the circumferential direction. The cam surface includes a pair of surface segments spaced from each other in the circumferential direction of the peripheral surface and convexly curved toward the peripheral surface so that these convexly curved surface segments are adapted to come in contact with the peripheral surface at once in the course of enhancing a tensity of the belt and a concavely curved surface segment extending between these two convexly curved surface segments and having a curvature radius which is the same as or less than a radius of the peripheral surface.

According to one preferred embodiment, a pair of the convexly curved surface segments defined by each of the cam surfaces in the buckle are sufficiently spaced from each other to ensure that the supporting walls can rise outward by itself in a radial direction of the air cylinder as the convexly curved surface segments come in contact at once in the course of enhancing the tensity of the belt.

In the case of the cylinder band for the buoyancy regulator according to this invention, a pair of the supporting walls constituting the buckle respectively have the first ends of which the respective end surfaces define the cam surfaces serving to enhance a tensity of the belt wound around the air cylinder wherein each of the cam surfaces includes a pair of the surface segments spaced from each other in the circumferential direction of the peripheral surface of the air cylinder and convexly curved toward the peripheral surface so that these convexly curved surface segments are adapted to come in contact with the peripheral surface at once and the surface segment extending between these two convexly curved surface segments so as to be concavely curved toward the peripheral surface and wherein the concavely curved surface segment has the curvature radius which is the same as or less than the radius of the peripheral surface opposed to this concavely curved surface segment. Such a unique arrangement ensures that the buckle can be kept rising on the peripheral surface of the air cylinder merely by putting the diver's hand in light contact with the supporting walls of the buckle.

In the case of the cylinder band according to the preferred embodiment of this invention, the supporting walls of the buckle can rise by itself on the peripheral surface of the air cylinder as the tensity of the cylinder band is enhanced. Once the supporting walls have risen by itself, the driver may take off his or her one hand from the supporting walls and freely use this one hand.

DETAILED DESCRIPTION OF THE PREFERRED EMBODIMENTS

Details of a cylinder band according to this invention will be more fully understood from the description given hereunder with reference to the accompanying drawings.

Figure 1:
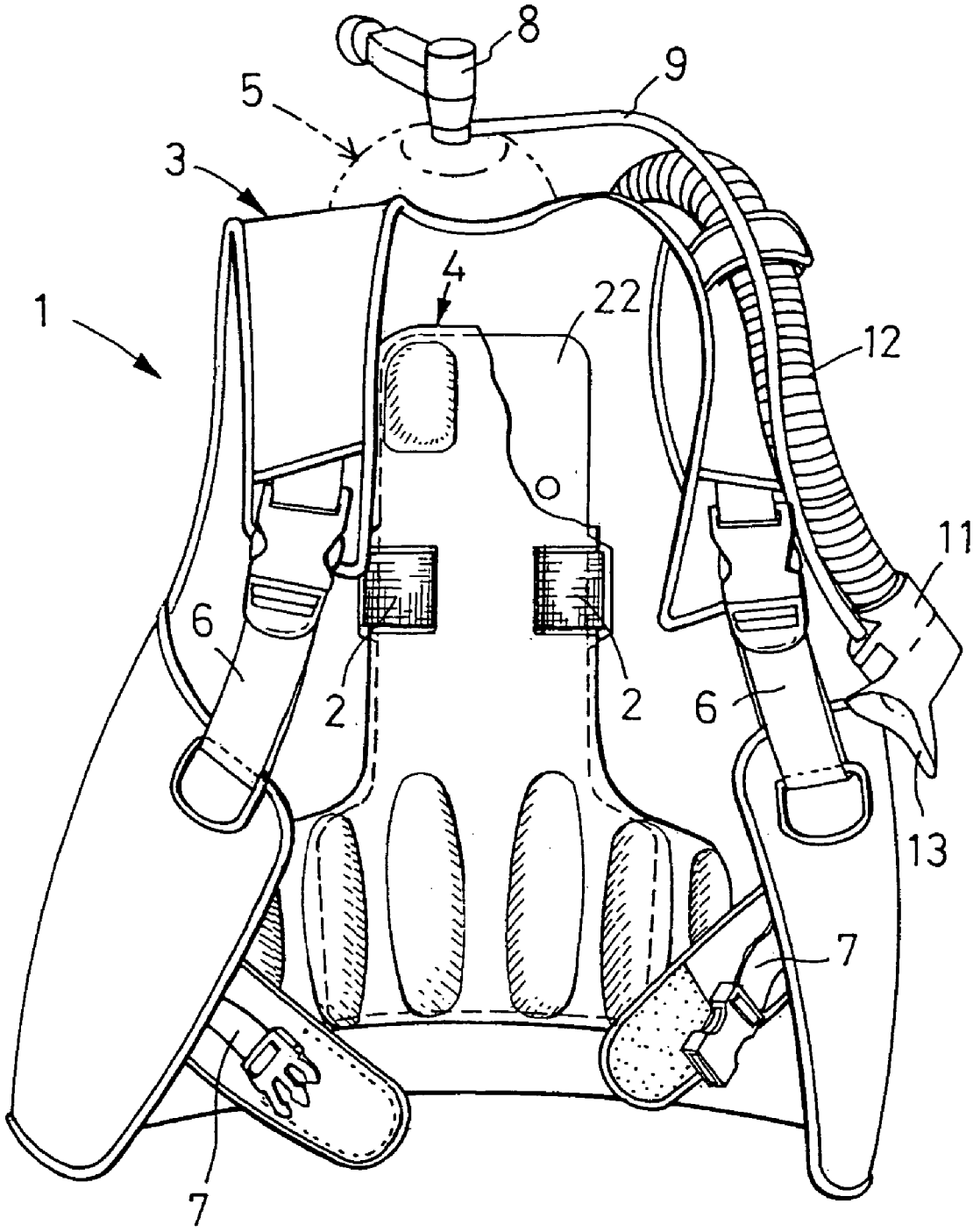
FIG. 1 is a front view showing a buoyancy regulator.
Figure 2:
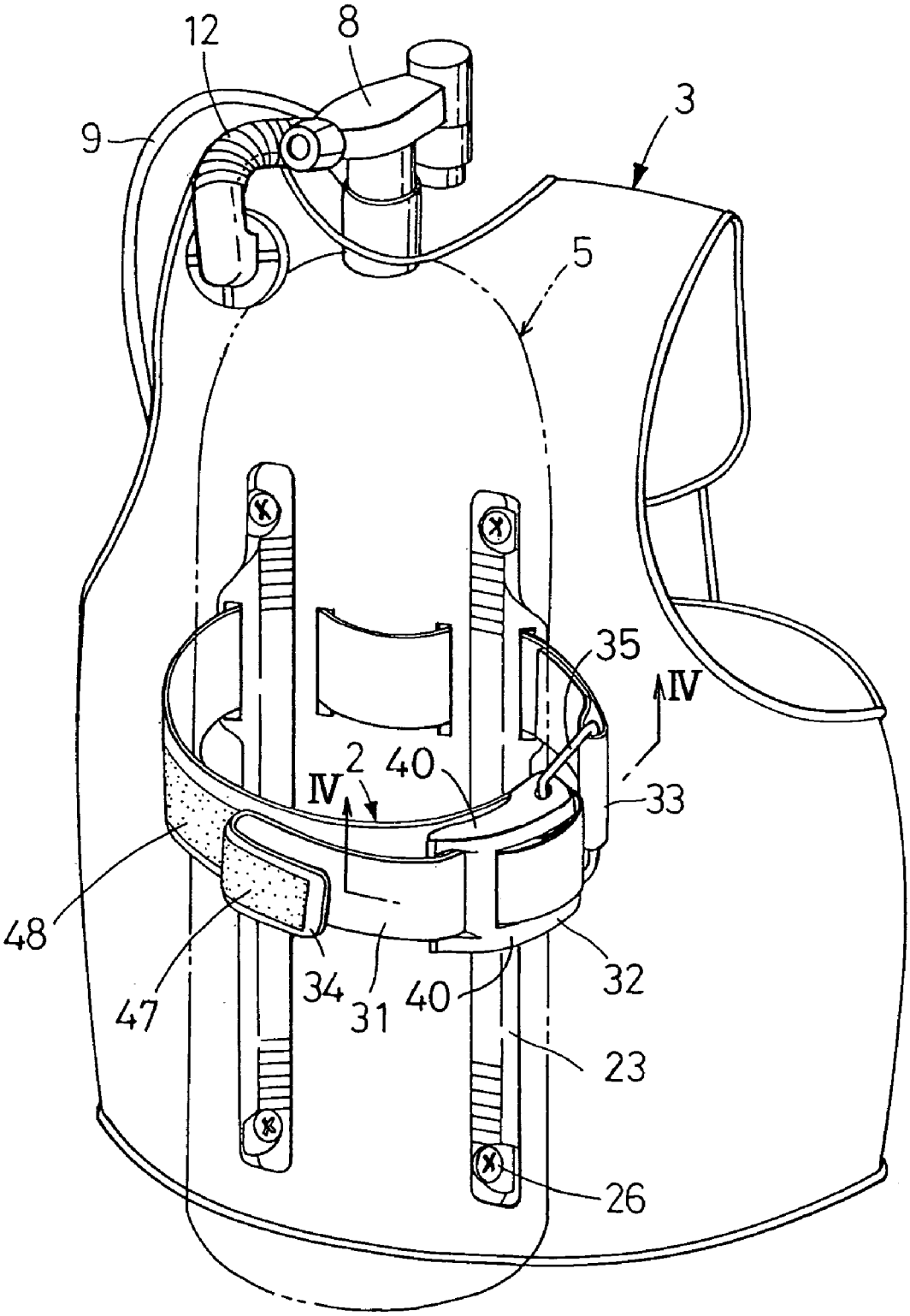
FIG. 2 is a rear view showing the buoyancy regulator.
Figure 7:
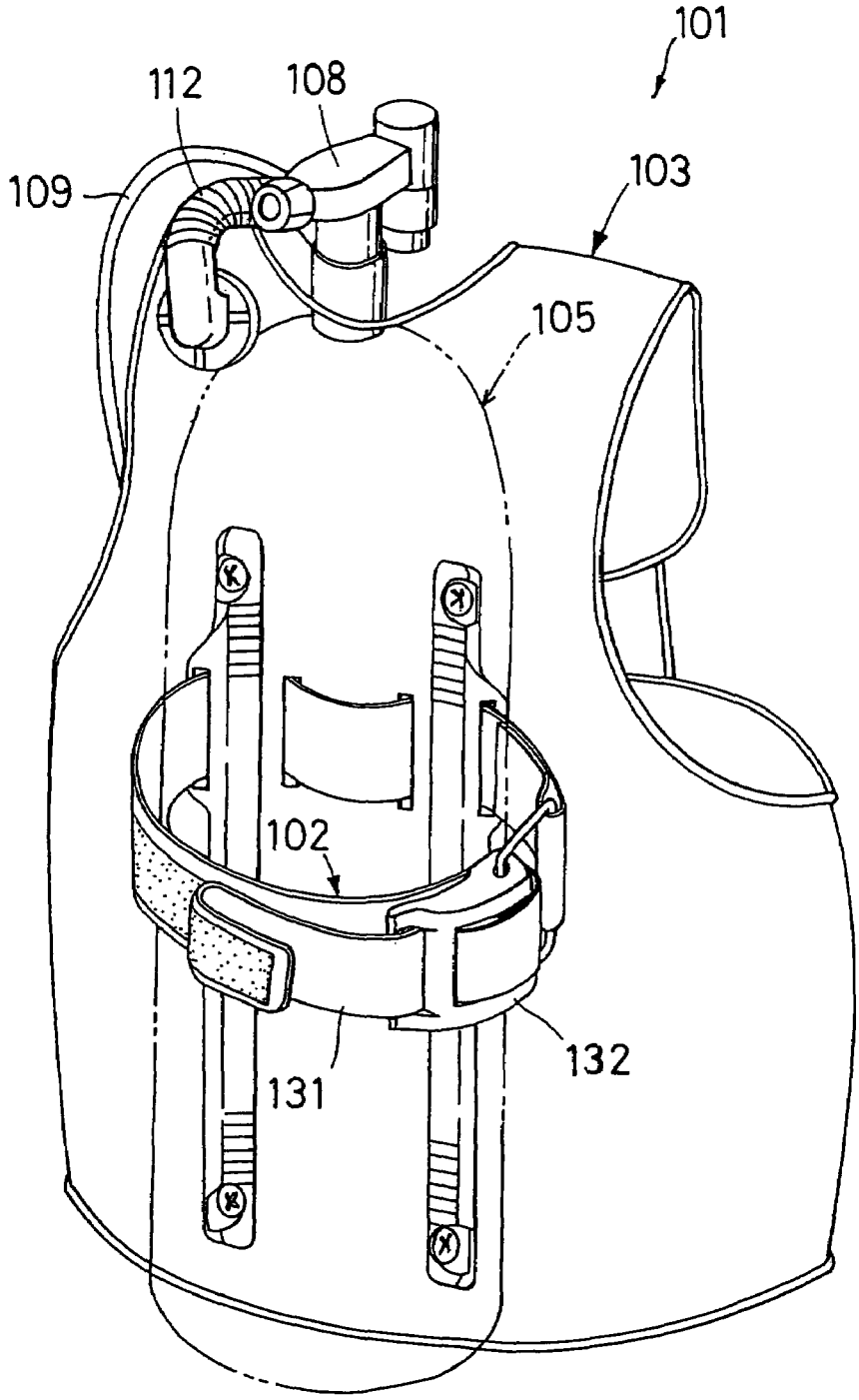
FIG. 7 PRIOR ART
FIG. 7 is a rear view showing an example of the buoyancy regulator of prior art.
Figure 8:
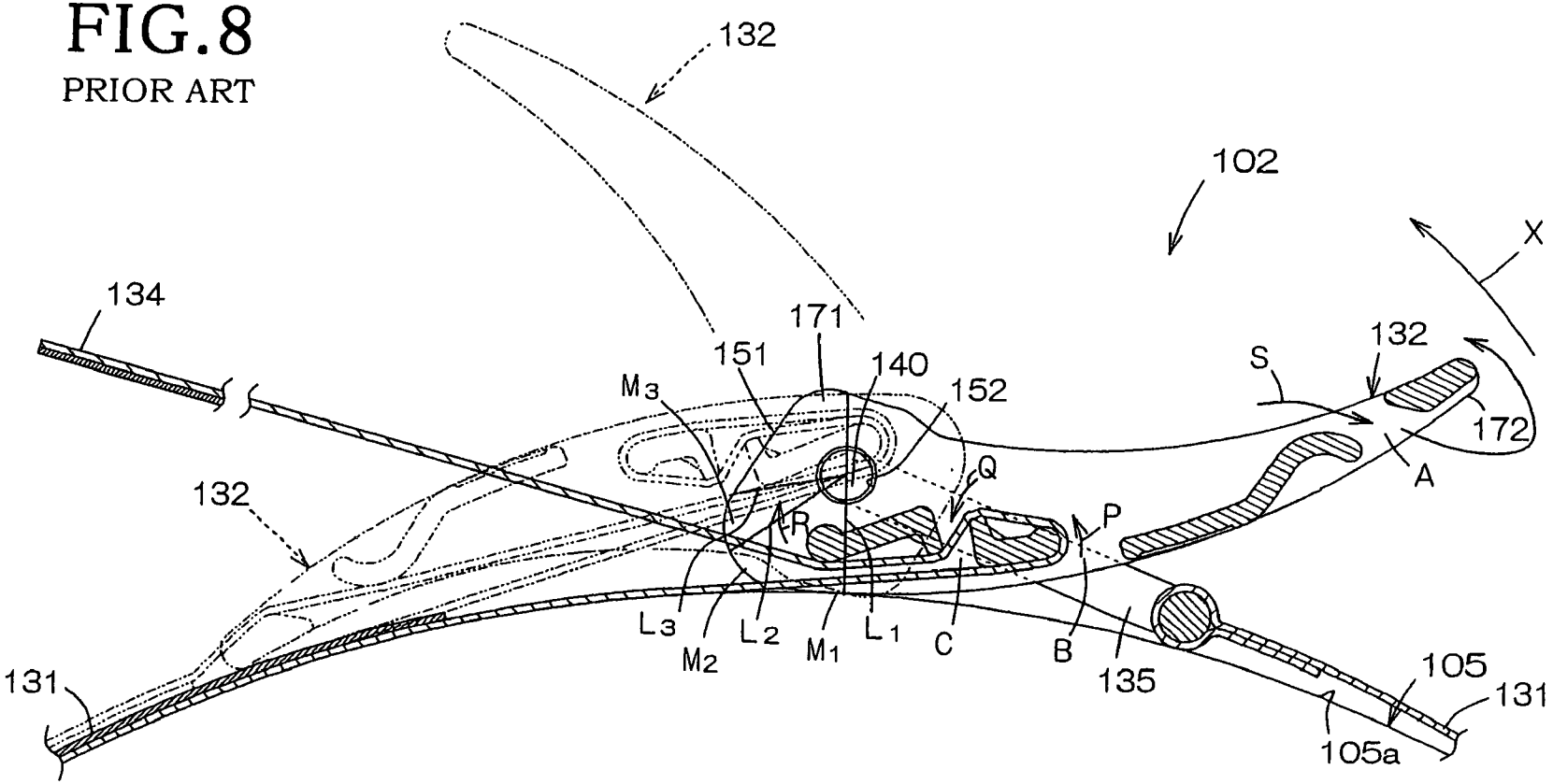
FIG.8 PRIOR ART
FIG. 8 is a view similar to FIG. 4, illustrating procedures for use of the cylinder band of prior art.

FIG. 1 is a front view showing a buoyancy regulator 1 for which a cylinder band 2 is used and FIG. 2 is a rear view showing the same. The buoyancy regulator 1 is substantially similar to a buoyancy regulator 101 shown in FIG. 7 and comprises a jacket 3 adapted to be fed with air for buoyancy regulation, a cylinder band 2, a cushion pad 4 and a backplate 22 covered with the cushion pad 4. The jacket 3 includes a shoulder belt 6 and a waist belt 7 both adapted to be length-adjusted. The air cylinder 5 is provided on its top with a first stage 8 from which a regulator hose 9 extends to a second stage 11. From this second stage 8, an inflation hose 12 extends to the dorsal side of the jacket 3. The second stage 11 is provided with a mouthpiece 13. The cylinder band 2 comprises a belt 31 extending in a transverse direction of the backplate 22, a coupler 35 and a buckle 32. The belt 31 extends externally, then internally and externally again on the dorsal side of the jacket 3. The buckle 32 is attached to a fixed end 33 of the belt 31 by means of the coupler 35 and the belt 31 may be length-adjusted by the buckle 31 to immobilize the air cylinder 5 on the backplate 22. The belt 31 includes a hook member 47 and a loop member 48 constituting together a mechanical fastener. After the air cylinder 5 has been immobilized, these two members 47, 48 are engaged with each other to fasten a free end 34 to the belt 31 itself. The backplate 22 is provided on the inner surface of the dorsal side of the jacket 3 and cooperates with a pair of attaching members provided on the outer surface of the dorsal side which are relatively long in a vertical direction to hold cloth of the jacket 3 between them. The backplate 22 and the attaching members 23 are fixed to the jacket 3 by means of bolts 26 and nuts (not shown).

Figure 3:
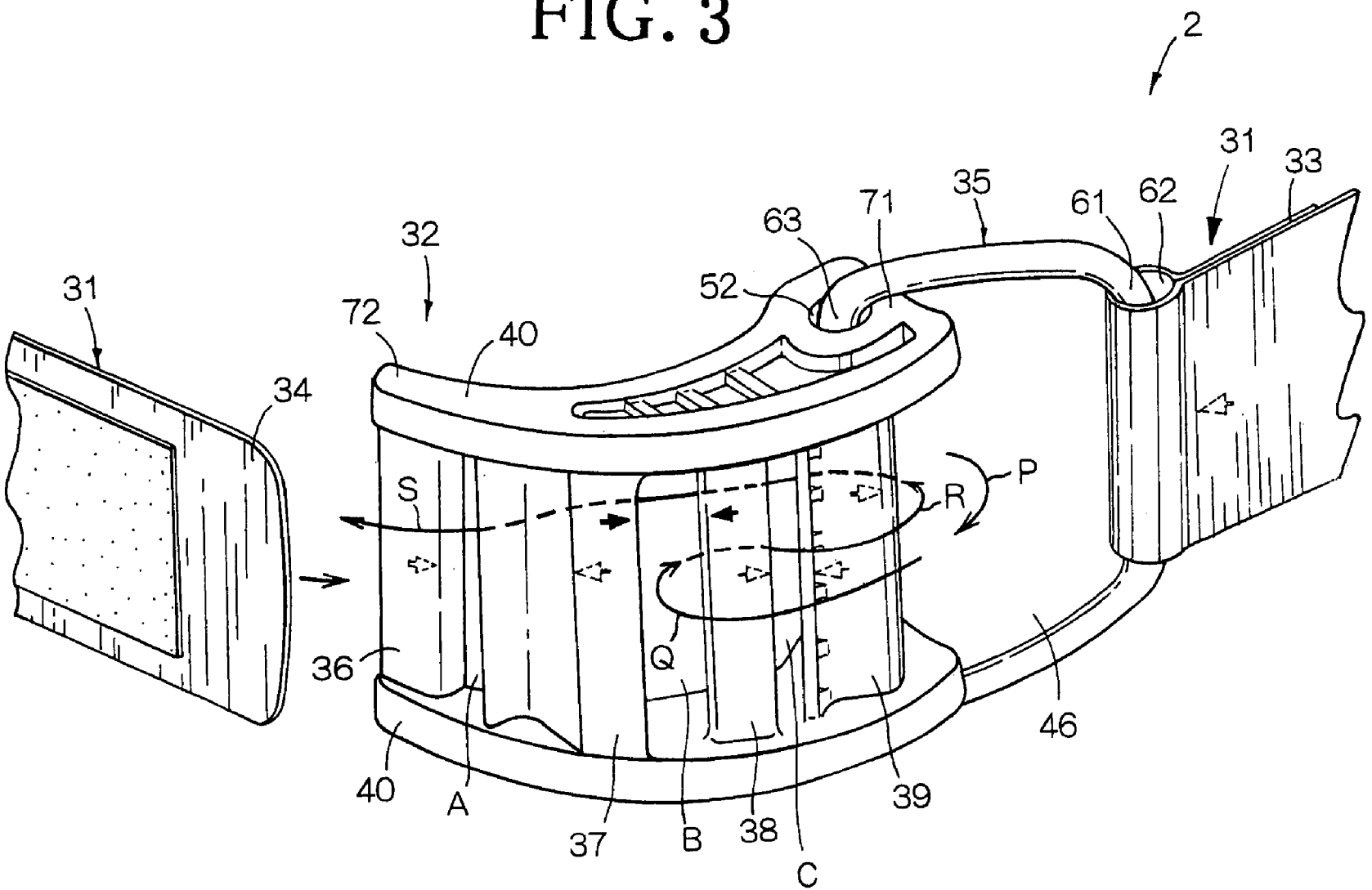
FIG. 3 is a perspective view showing a part of a cylinder band.

FIG. 3 is a perspective view showing a part of the cylinder band 2 relieved of its fastened state shown in FIG. 1. The belt 31 and the buckle 32 constituting together the cylinder band 2 are coupled to each other with interposition of the coupler 35 formed by bending a metallic round bar. More specifically, a segment 61 of the coupler 35 fully extends in a through-hole 62 defined by one end 33 of the belt 31 folded back and functions as a pivot for the belt 31 while a segment 63 of the coupler 35 opposed to the segment 63 fully extends in a vertical through-hole 52 of the buckle 32 and functions as a pivot for the buckle 32. While the through-hole 52 is illustrated in FIG. 3 as if it extends through only a top supporting wall 40 as a component of the buckle 32, it should be understood that the through-hole 52 extends through a bottom supporting wall 40 also. Of the belt 31 constructed in this manner, the end 33 is able to swing around the segment 61 of the coupler 35 functioning as the pivot for the belt 31 while the buckle 32 is able to swing around the segment 63 of the coupler 35 functioning as the pivot for the buckle 32.

Now the buckle 32 will be described as immediately before the air cylinder 5 is immobilized as shown in FIG. 2. The buckle 32 comprises a pair of the supporting walls 40 extending in a circumferential direction of the air cylinder 5 in parallel to each other along a peripheral surface 5*a* of the air cylinder 5 and first, second, third and fourth dividing walls 36, 37, 38, 39 extending in parallel one to another in a longitudinal direction which is orthogonal to the circumferential direction of the air cylinder 5 between a pair of the supporting walls 40. Each of the supporting walls 40 has a first end 71 formed with the through-hole 52 and a second end 72 opposed to and being most remote from the first end 71. Between each pair of the adjacent dividing walls, an insertion slit for the free end 34 of the belt 31 is formed. The insertion slit A is formed between the first dividing wall 36 and the dividing wall 37, the second insertion slit B is formed between the second dividing wall 37 and the third dividing wall 38 and the third insertion slit C is formed between the third dividing wall 38 and the fourth dividing wall 39. The fourth dividing wall 39 and the fixed end 33 of the belt 31 cooperate with the coupler 35 to form an opening 46. Through such buckle 32, the free end 34 of the belt 31 wound round the air cylinder 5 is guided in a direction defined by arrows P, Q, R, S. Specifically, the free end 34 is guided through the opening 46 from the inner side of the buckle 32 to the outer side of the buckle 32 as indicated by the arrow P, then through the second insertion slit B and the third insertion slit C again to the opening 46 as indicated by the arrows Q, R and is guided through the first insertion slit A from the inner side of the buckle 32 in the direction of the arrow S.

Figure 4:
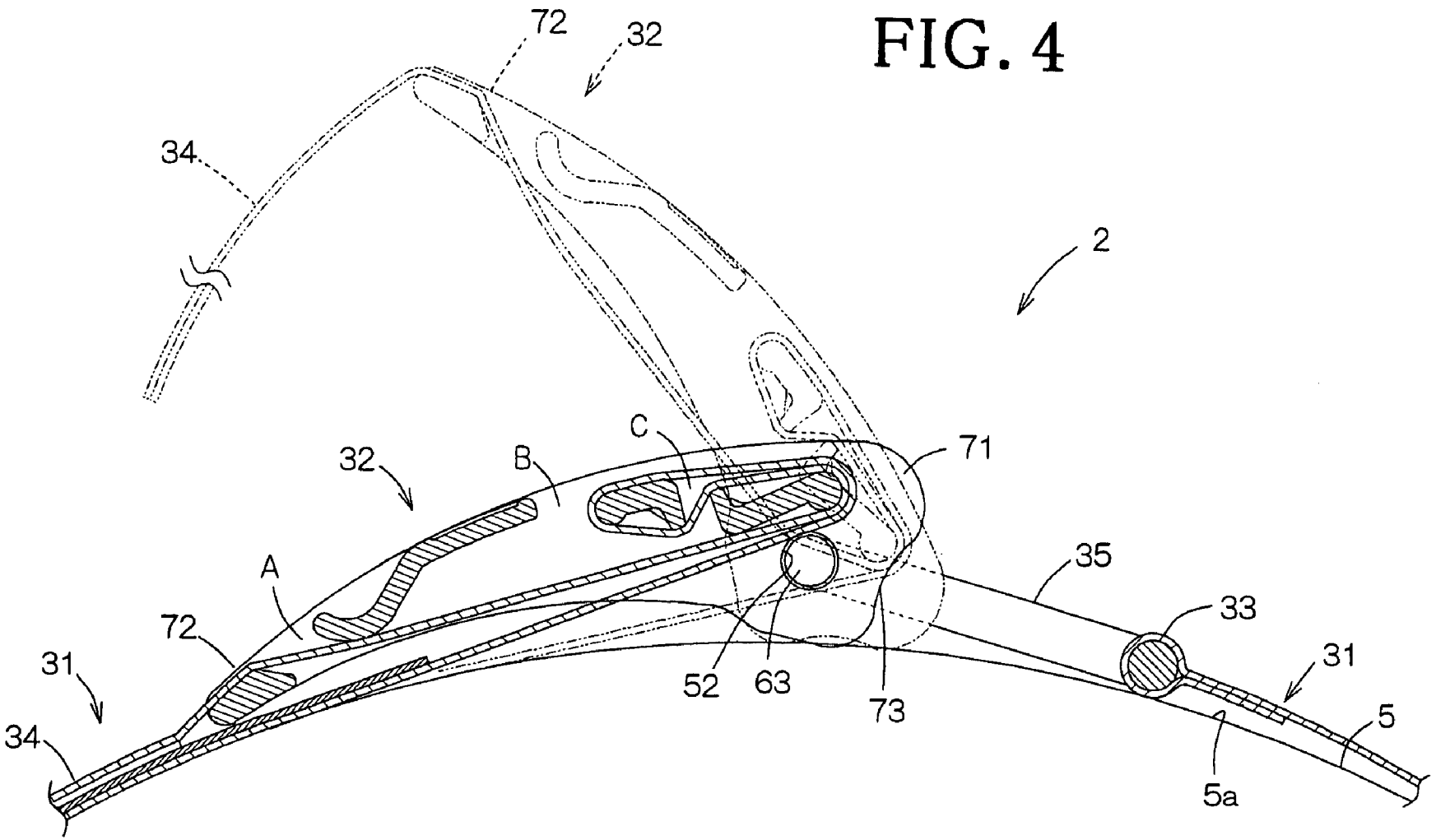
FIG. 4 is a sectional view taken along the line IV-IV in FIG. 2, illustrating procedures for use of the cylinder band.
Figure 5:
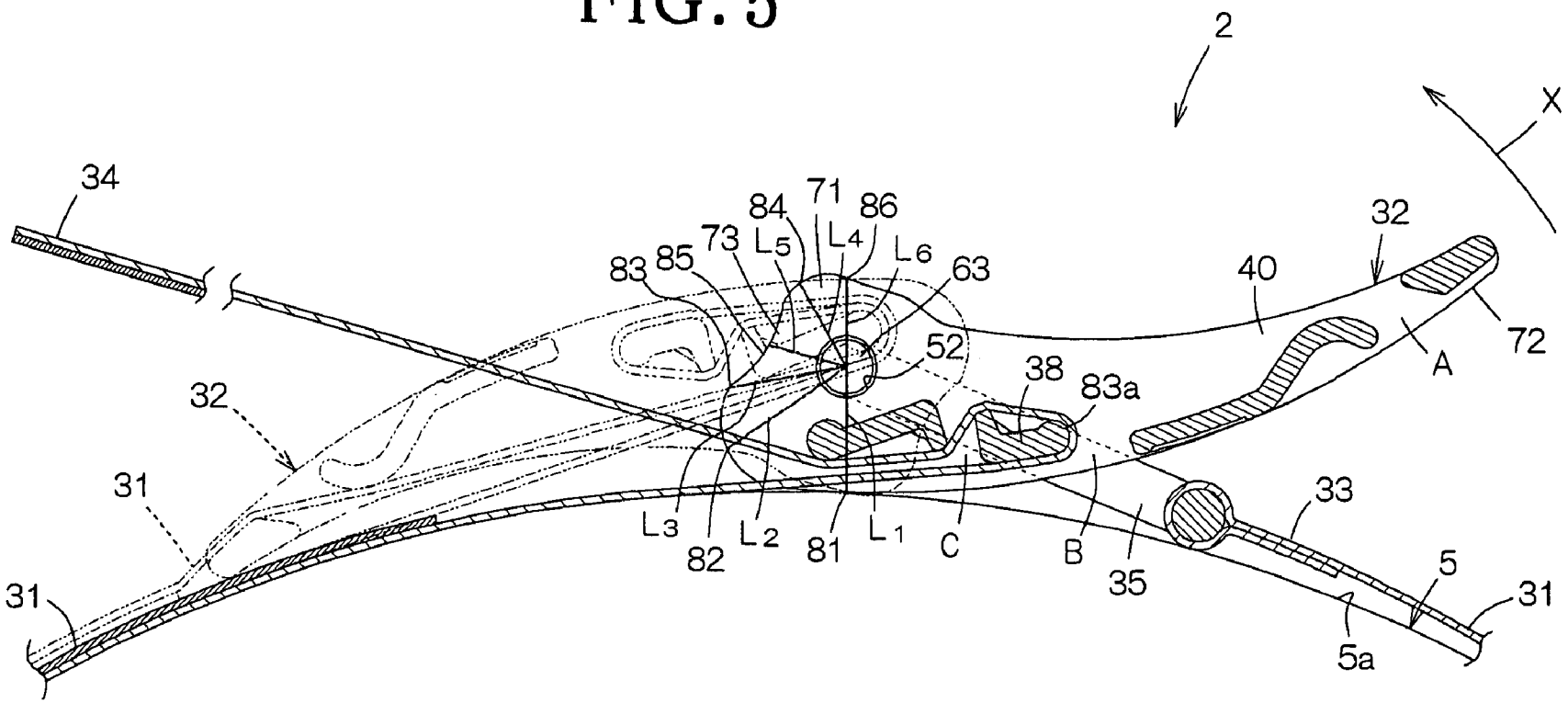
FIG. 5 is a view similar to FIG. 4, illustrating procedures for use of the cylinder band.
Figure 6:
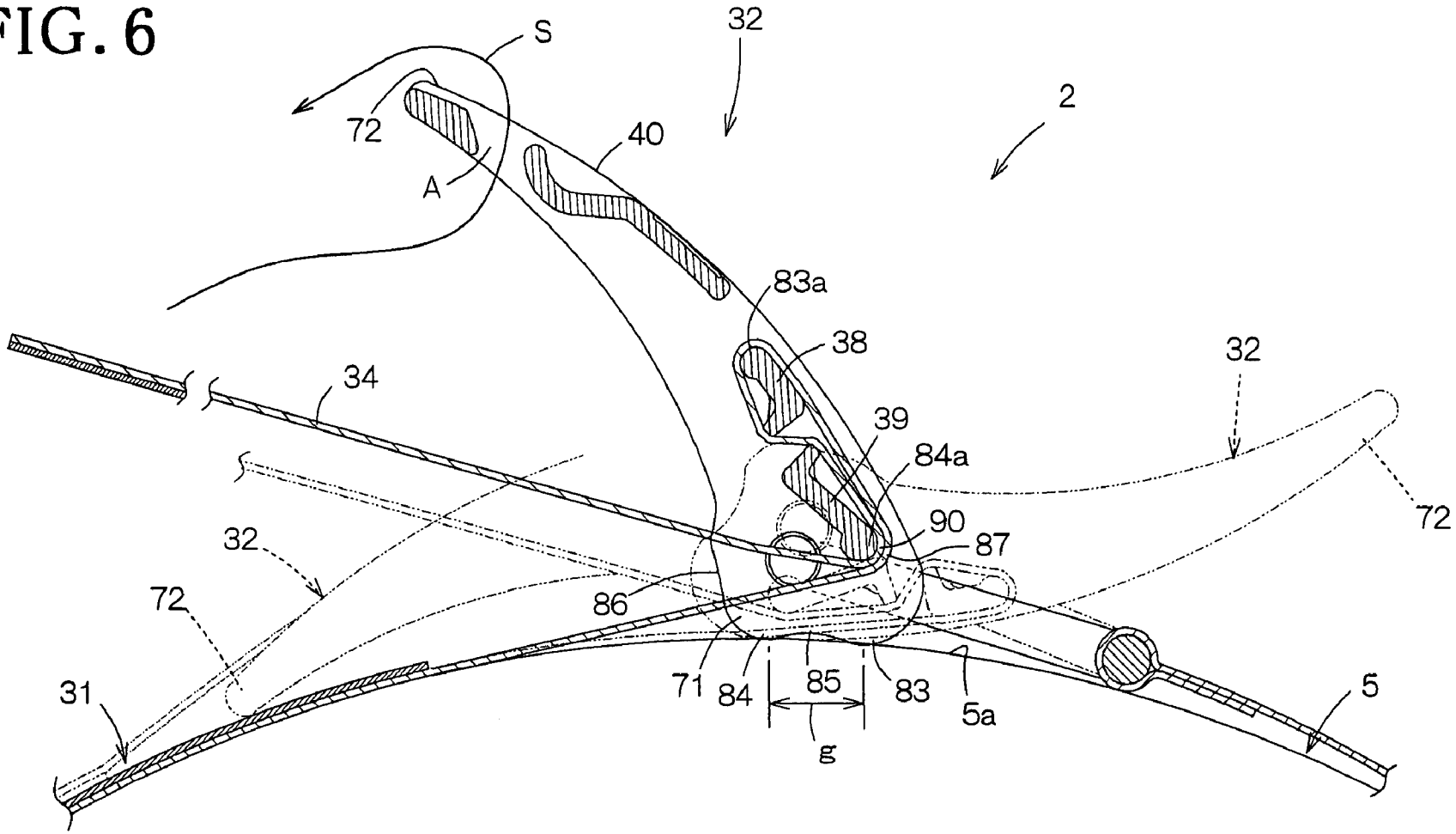
FIG. 6 is a view similar to FIG. 4, illustrating procedures for use of the cylinder band.

FIGS. 4, 5 and 6 illustrate procedures according to which the cylinder band 2 is used to immobilize the air cylinder 5 on the backplate 22. FIG. 4 is a sectional view taken along the line IV-IV in FIG. 2, FIG. 5 is a view similar to FIG. 4, illustrating the buckle 32 being ready for immobilizing the air cylinder 5 and FIG. 6 is a view similar to FIG. 4, illustrating a transitional state of the buckle 32 from the state illustrated by FIG. 5 to the state illustrated by FIG. 4. In FIG. 6, the top and bottom supporting walls 40 rise outward from the peripheral surface 5*a* in a radial direction of the air cylinder 5.

The procedures for use of the cylinder band 2 to immobilize the air cylinder 2 on the backplate 22 will be described with reference to FIG. 5. First, the belt 31 of the cylinder band 5 is wound round the air cylinder 5 and the buckle 32 is swung around the pivot 63 so that the second end 72 may be positioned aside toward the fixed end 33 of the belt 31 as indicated by a solid line in FIG. 5. From the left hand of FIG. 5, the free end 34 of the belt 31 is guided along the peripheral surface 5*a* of the air cylinder 5 through the second insertion slit B, then folded back along an end 83*a* of the third dividing wall 38 and then through the third insertion slit C as seen in FIG. 5. Thereafter, the free end 34 is guided toward the left hand of FIG. 5. The free end 34 is tugged toward the left hand and comes in close contact with the peripheral surface 5*a* with somewhat tensity. The first ends 71 of the buckle 32 are moved along the peripheral surface 5*a* in the circumferential direction of the air cylinder 5 and end surfaces 73 function to enhance a tightness of the belt 31. As viewed clockwise around the through-hole 52 extending through these end surfaces 73, the buckle 32 includes a first convexly curved surface segment 81, a second convexly curved surface segment 82 contiguous to the first convexly curved surface segment 81, a third convexly curved surface segment 83 contiguous to the second convexly curved surface segment 82, a first concavely curved surface segment 85 contiguous to the third convexly curved surface segment 83, a fourth convexly curved surface segment 84 and a second concavely curved surface segment 86 contiguous to the fourth convexly curved surface segment 84. In a step illustrated by FIG. 5, the first convexly curved surface segment 81 of the buckle 32 is in contact with the peripheral surface 5*a* of the air cylinder 5. Distances from the center of the through-hole of the first end 71 to apices of the first convexly curved surface segment 81, the second convexly curved surface segment 82, the third convexly curved surface segment 83 and the fourth convexly curved surface segment 84 are respectively represented by $L_1$, $L_2$, $L_3$, $L_4$ while distances from the center of the through-hole 52 to bottoms of the first concavely curved surface segment 85 and the second concavely curved surface segment 86 are respectively represented by $L_5$, $L_6$. These distances are in relationships as follow: $L_2$ as well as $L_3>L_1$; $L_4<L_1$; and $L_5<L_3$. In the case of the buckle 32 shown in FIG. 5, the region in which the end surfaces 73 come in contact with the air cylinder 5 transfers from the first convexly curved surface segment 81 to the second convexly curved surface segment 82 as the second ends 72 swing around the pivot 63 in the direction indicated by the arrow X. In this course, the belt 31 is tugged by the end 83*a* of the third dividing wall 38 so as to tighten the air cylinder 5 with a high tensity.

Further swinging of the second end 72 causes the buckle 32 to come into a state as shown in FIG. 6. Referring to FIG. 6, a segment 90 of the belt 31 held in contact with an end 84*a* of the fourth dividing wall 39 and a segment 87 of the belt 31 lapping over the segment 90 are tightly pressed against each other to prevent the belt 31 from moving in the direction in which the belt 31 might slacken, on one hand, and the third convexly curved surface segment 83 and the fourth convexly curved surface segment 84 on the first ends 71 of the respective supporting walls 40 are simultaneously pressed against the peripheral surface 5*a*, on the other hand. In this way, the buckle 32 rises outward on the peripheral surface 5*a* in the radial direction of the air cylinder 5. Each of the supporting walls 40 constituting the buckle 32 is pressed against the peripheral surface 5*a* at two regions which are contiguous in the circumferential direction in this manner, allowing the buckle 32 to be maintained in its rising position merely by lightly laying the diver's hand on the supporting walls 40. In addition, a distance g by which the third convexly curved surface segment 83 and the fourth convexly curved surface segment 84 are spaced apart from each other with interposition of the first concavely curved surface 85 may be dimensioned as lame as possible, for example, in a range of 10 to 25 mm, depending on the particular diameter of the air cylinder 5, to ensure that the buckle 32 can rise by itself with a desired tensity of the belt 31. Advantageously, it is no more necessary for the diver to lay his or her hand on the supporting walls 40. With the buckle 32 rising by itself as shown in FIG. 6, the diver can freely use his or her both hands in order to guide the free end 34 of the belt 31 in the direction indicated by the arrow 5 through the first insertion slit A. Then the free end 34 may be tugged toward the left hand of FIG. 6 to ensure that the buckle 32 is swung until the second concavely curved surface 86 of the first end 71 and the vicinity thereof come in contact with the peripheral surface 5*a* whereupon the second end 72 moves to the position indicated by imaginary lines in FIG. 5, i.e., the position shown in FIG. 1. In this manner, the procedures to immobilize the air cylinder 5 on the backplate 22 are completed. The first concavely curved surface 85 in the supporting walls 40 functioning in such a manner is shaped so that the first concavely curved surface 85 comes in contact or not with the peripheral surface 5*a* opposed to this first concavely curved surface 85 when the third convexly curved surface segment 83 and the fourth convexly curved surface segment 84 come in contact with the peripheral surface 5*a*. In other words, from the viewpoint that the air cylinder 5 for which the cylinder band 2 according to this invention is used may have various diameters, for example, in a range of 170 to 210 mm, the first concavely curved surface 85 is shaped to have a curvature radius which is the same as or less than the minimum radius of the usually used air cylinder. The second concavely curved surface 86 preferably has a curvature radius which is same as or less than the minimum radius of the air cylinder 5.

This invention allows the cylinder band adapted to easily immobilize the air cylinder on the buoyancy regulator to be produced.

The entire discloses of Japanese Patent Application No. 2004-235337 filed on Aug. 12, 2004 including specification, drawings and abstract are herein incorporated by reference in its entirety.

What is claimed is:

1. A cylinder band for a buoyancy regulator comprising:

a belt adapted to be wound around a peripheral surface of an air cylinder destined to be immobilized on a backplate of said buoyancy regulator and having longitudinally opposite ends;

a buckle attached to one of said longitudinally opposite ends by means of a coupler provided separately of said belt and provided with insertion slits through which the other of said longitudinally opposite ends may be guided to adjust a length of said belt;

said buckle comprising a pair of supporting walls extending in parallel to each other in a circumferential direction of said peripheral surface of said air cylinder destined to be immobilized on said backplate and a plurality of dividing walls extending between the pair of said supporting walls in parallel one to another in a longitudinal direction of said air cylinder, each of said insertion slits being defined between each pair of the adjacent dividing walls, the pair of said supporting walls respectively have first ends and second ends opposed to said first ends in said circumferential direction of said air cylinder wherein said first ends are attached to said coupler so that said first ends swing around a pivot extending in the longitudinal direction of said air cylinder and said second ends swing off from or toward said peripheral surface of said air cylinder as said first ends swing around said pivot; and each of respective end surfaces of said first ends defines a cam surface serving to enhance a tensity of said belt guided through said insertion slits and pressed against said peripheral surface of said air cylinder in said circumferential direction wherein said cam surface includes a pair of surface segments spaced from each other in said circumferential direction of said peripheral surface and convexly curved toward said peripheral surface so that these convexly curved surface segments are adapted to come in contact with the peripheral surface at once in the course of enhancing a tensity of said belt and a concavely curved surface segment extending between these two convexly curved surface segments and having a curvature radius which is same as or less than a radius of the peripheral surface to ensure that said buckle can rise by itself on said peripheral surface in the radial direction of said air cylinder.

2. The cylinder band as defined by claim 1, wherein a pair of said convexly curved surface segments defined by each of said cam surfaces in said buckle are sufficiently spaced from each other to ensure that said supporting walls can rise outward by itself in a radial direction of said air cylinder as said convexly curved surface segments come in contact at once in the course of enhancing the tensity of said belt.

* * * * *

UNITED STATES PATENT AND TRADEMARK OFFICE

CERTIFICATE OF CORRECTION

PATENT NO. : 7,322,074 B2
APPLICATION NO. : 11/197513
DATED : January 29, 2008
INVENTOR(S) : Takeuchi et al.

It is certified that error appears in the above-identified patent and that said Letters Patent is hereby corrected as shown below:

On the title page, insert item [73]

Assignee is TABATA CO., LTD., of Tokyo, Japan

Signed and Sealed this

Second Day of September, 2008

JON W. DUDAS
*Director of the United States Patent and Trademark Office*